US006994484B2

(12) United States Patent
Kageyama et al.

(10) Patent No.: US 6,994,484 B2
(45) Date of Patent: Feb. 7, 2006

(54) COMPOSITE WRITING TOOL

(75) Inventors: Hidehei Kageyama, Kawagoe (JP); Tadao Odaka, Kawagoe (JP)

(73) Assignee: Kotobuki & Co., Ltd., Kawagoe (JP)

( * ) Notice: Subject to any disclaimer, the term of this patent is extended or adjusted under 35 U.S.C. 154(b) by 0 days.

(21) Appl. No.: 11/128,400

(22) Filed: May 13, 2005

(65) Prior Publication Data

US 2005/0265767 A1 Dec. 1, 2005

(30) Foreign Application Priority Data

May 25, 2004 (JP) ..... 2004-155140

(51) Int. Cl.
*B43K 27/00* (2006.01)

(52) U.S. Cl. ..... 401/33; 401/30; 401/32

(58) Field of Classification Search ..... 401/29–35, 401/99, 109
See application file for complete search history.

(56) References Cited

U.S. PATENT DOCUMENTS 4,283,151 A * 8/1981 Sekiguchi ..... 401/33
5,642,953 A * 7/1997 Kobayashi et al. ..... 401/30
5,713,680 A * 2/1998 Yoshino et al. ..... 401/30

FOREIGN PATENT DOCUMENTS

JP 2001-328393 11/2001

* cited by examiner

*Primary Examiner*—Tuan Nguyen
(74) *Attorney, Agent, or Firm*—McGinn IP Law Group, PLLC

(57) ABSTRACT

A composite writing tool wherein when the rear shaft is rotated relative to a front shaft, a cam sleeve rotates with the rear shaft, and the relative rotation occurring between the cam sleeve and the front shaft and an intermediate shaft causes one of writing shafts guided in the axial direction by the intermediate shaft to be selectively held in a protruding position, and when a knock sleeve is knocked, the cam sleeve is knocked to advance a lead of the writing shaft protruded by the cam sleeve. The rear part of the intermediate shaft is inserted into the cam sleeve, and engaging pieces of the rear part of the intermediate shaft penetrate a through hole formed in a perpendicular engaging wall formed in a tail cap fastened to the rear end of a rear shaft, and are engaged with the through hole. The cam sleeve and the knock sleeve are linked to each other through a recess elsewhere than the through hole in the engaging wall.

12 Claims, 11 Drawing Sheets

COMPOSITE WRITING TOOL

BACKGROUND OF THE INVENTION

1. Field of the Invention

The present invention relates to a composite writing tool accommodating a plurality of writing shafts and selectively protruding one or another of these writing shafts to make it usable for writing, and more particularly to a composite writing tool provided with a knocking member protruding from its rear shaft for use in knocking.

2. Description of the Related Art

A conventional writing tool of this kind is disclosed, for instance, in Japanese Patent Laid-Open No. 2001-328393 whose application was filed by the same assignee as this application.

The composite writing tool described in the above Patent publication comprises a front shaft, a rear shaft, and an intermediate shaft inserted between the front shaft and the rear shaft. The intermediate shaft is separably coupled to the front shaft, but is rotatably coupled to the rear shaft so as to be unmovable in the axial direction of the rear shaft. The intermediate shaft combines the front shaft and the rear shaft in a separatable manner and in a combining state, allows them to rotate relative to each other and does not allow them to move relative to each other in the axial direction. The front shaft accommodates a plurality of writing shafts always urged in a backward direction, and guided by the intermediate shaft so as to be move in an axial direction. The composite writing tool further comprises a cam sleeve for holding one of the writing shafts in a protruding state, one of the writing shafts being selected upon a relative rotation between the cam sleeve and the front shaft and the intermediate shaft and guided in the axial direction by the intermediate shaft. The cam sleeve is disposed within the rear shaft so as to be unrotatable relative to the rear shaft but movable in the axial direction. The composite writing tool further comprises a knocking member coupled to the cam sleeve and protruding from the rear end of the rear shaft, whereby the writing shaft held to be protruded by the cam sleeve is subjected to the knocking operation when the knocking member is knocked.

The intermediate shaft has a rear sleeve portion which extends substantially concentrically into the rear shaft in order to couple the intermediate shaft to the rear shaft so as to be rotatable but unmovable in the axial direction of the rear shaft. The rear sleeve portion is provided with engaging protrusions at the rear end, and the engaging protrusions are engaged with an engaging step portion formed on the inner surface of the rear shaft.

Thus, this conventional configuration has a triple-sleeve structure consisting of the rear shaft, the intermediate shaft and the cam sleeve, and for this reason involves a problem that an outside diameter of the shaft tends to become greater. However, as it is necessary to arrange the cam sleeve and the intermediate shaft within the rear shaft and to link the cam sleeve to the knocking member, it is not easy to attach the intermediate shaft to the rear shaft with avoiding bulkiness.

SUMMARY OF THE INVENTION

In view of the foregoing and other drawbacks, disadvantages and problems of the conventional structure, an object of the present invention is to provide a composite writing tool which is provided with a knocking member protruding from the rear shaft to be used in knocking but permits the shaft to be reduced in outside diameter.

In order to achieve the above-stated object, according to the invention, a composite writing tool according to the present invention comprises a front shaft for accommodating a plurality of writing shafts always urged backward, a rear shaft, an intermediate shaft between the front shaft and the rear shaft for guiding the writing shafts in the axial direction, said intermediate shaft being unrotatably coupled to the front shaft and rotatably coupled to the rear shaft, a cam sleeve disposed within the rear shaft so as to be unrotatable and movable in the axial direction relative to the rear shaft, for selectively protruding one of the writing shafts and retracting all of the writing shafts upon a relative rotation between the cam sleeve and, the front shaft and the intermediate shaft, and a knocking member coupled to the cam sleeve and protruding out of the rear shaft, whereby knocking of the knocking member allows the writing shaft protruded by the cam sleeve to be subjected to a knocking operation. The rear part of the intermediate shaft is inserted into the cam sleeve, the rear end of the intermediate shaft penetrates a through hole formed in an engaging wall perpendicular to the axial direction within the rear shaft and is engaged with the through hole, and the cam sleeve and the knocking member are coupled to each other through an opening provided within the rear shaft or in the rear shaft.

According to the invention, since the rear part of the intermediate shaft is inserted into the cam sleeve and the rear end of the intermediate shaft is engaged with the through hole formed in the engaging wall, the intermediate shaft can be fitted within the rear shaft in a rotatable manner relative to the rear shaft. As the outside diameter of the intermediate shaft is reduced to form it in a non-bulky shape within the rear shaft, the outside diameter of the shaft can be kept small eventually. Since the cam sleeve and the knocking member are linked to each other through the opening formed within the rear shaft or in the rear shaft, when the knocking member is knocked, the knocking force is transmitted to the cam sleeve, and the force can be transmitted via the cam sleeve to one of the writing shafts.

The opening can be formed elsewhere than the portion formed with the through hole in the engaging wall.

The opening can include a non-annular opening formed in the engaging wall or between the engaging wall and the rear shaft and positioned at an outer portion in a radial direction than the through hole. Since the cam sleeve and the knocking member are linked to each other through the non-annular shaped opening, the cam sleeve can be disposed so as to be unrotatable relative to the rear shaft.

An engaging piece passing the opening can be formed at the rear end of the cam sleeve, and the knocking member can be linked to the engaging piece. Since the engaging piece of the cam sleeve and the knocking member are linked to each other, the linking procedure can be facilitated because the engaging piece can be moved in the radial direction, and there will be no fear of damaging any member during the assembling process.

In a one embodiment, the knocking member can include a clip. In another embodiment, the opening can be formed in a side surface of the rear shaft.

The engaging wall can be formed in a tail cap fastened to the rear end of the rear shaft or can be formed integrally with the rear shaft.

The present disclosure relates to subject matter contained in Japanese Patent Application No. 2004-155140, filed on May 25, 2004, which is expressly incorporated herein by reference in its entirety.

DETAILED DESCRIPTION OF THE PREFERRED EMBODIMENTS

Figure 1:
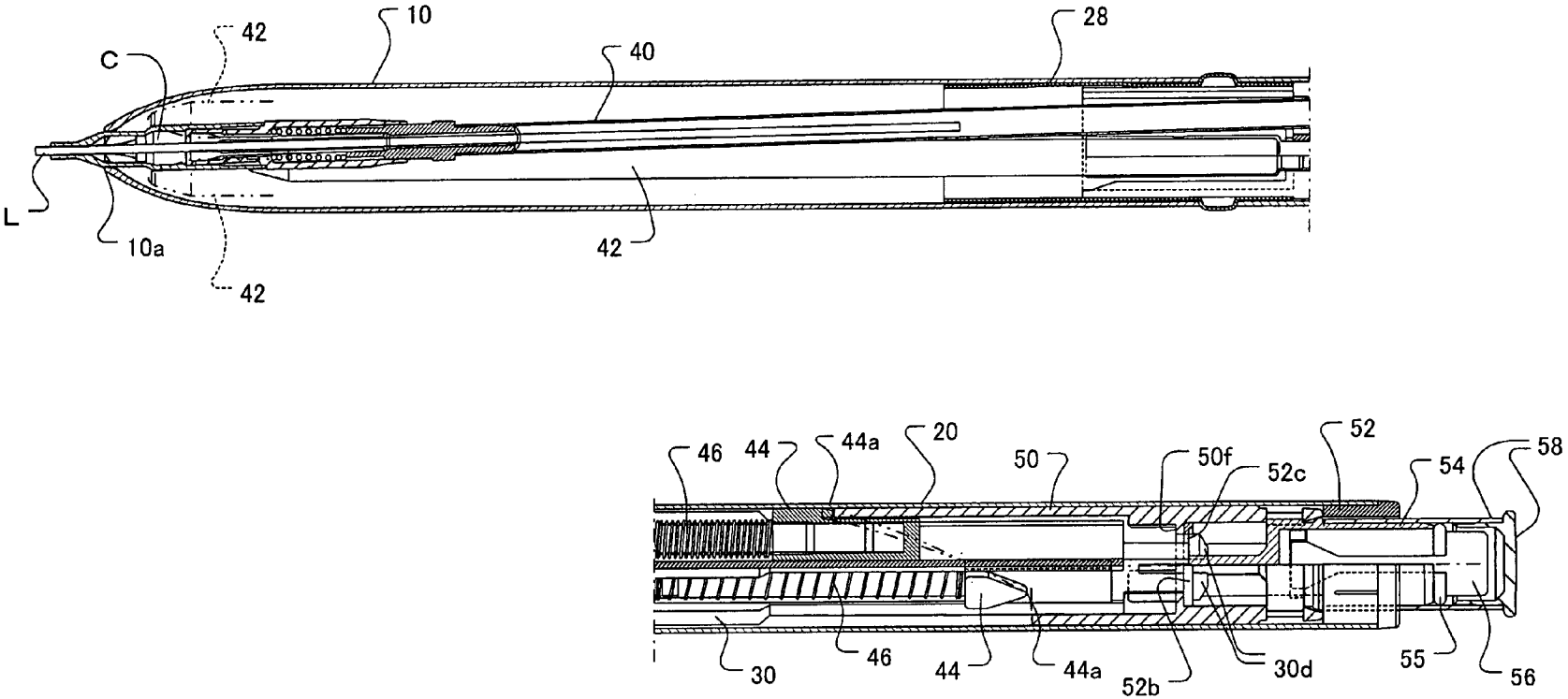
FIG. 1 is an overall longitudinal section (including a partial side view) of a composite writing tool of a first preferred embodiment according to the present invention.

Preferred embodiments of the present invention will be described in detail below with reference to the accompanying drawings.

First Preferred Embodiment

FIG. 1 through FIG. 7 show a composite writing tool according to a first preferred embodiment of the invention. Referring to the drawings, the composite writing tool includes a front shaft 10 and a rear shaft 20.

The front shaft 10 and the rear shaft 20 in this embodiment are respectively composed of thin-wall metal pipes to keep the outside diameter of the shaft small, however, their material is not limited to this and may be aplastic. Further, though each of the front shaft 10 and the rear shaft 20 in this case is formed as a one-piece component, but can as well be configured of a plurality of parts. A tip opening 10*a* for allowing a tip of each writing shaft which is explained hereinafter, to protrude is formed at the tip of the front shaft 10.

A plastic intermediate shaft 30 is inserted between the front shaft 10 and the rear shaft 20 via a metallic fit-in sleeve 28. The fit-in sleeve 28 is detachably linked to the front shaft 10 and is unrotatable relative to it, and is undetachably and rotatably linked to the rear shaft 20. The fit-in sleeve 28 may be integrated with the intermediate shaft 30. The intermediate shaft 30 is separably coupled to the front shaft 10 via the fit-in sleeve 28 so as to be unrotatable relative to the front shaft 10, and is rotatable relative to the rear shaft 20. The intermediate shaft 30 combines the front shaft 10 and the rear shaft 20 in a separatable manner and in a combining state, allows them to rotate relative to each other and does not allow them to move in the axial direction relative to each other.

Figure 2B:
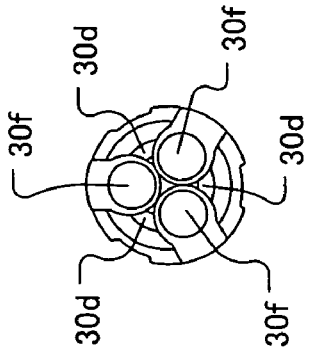
FIG. 2A is a side view of a intermediate shaft and FIG. 2B is a view of the same seen in the direction of arrow 2B in FIG. 2A.
Figure 2A:
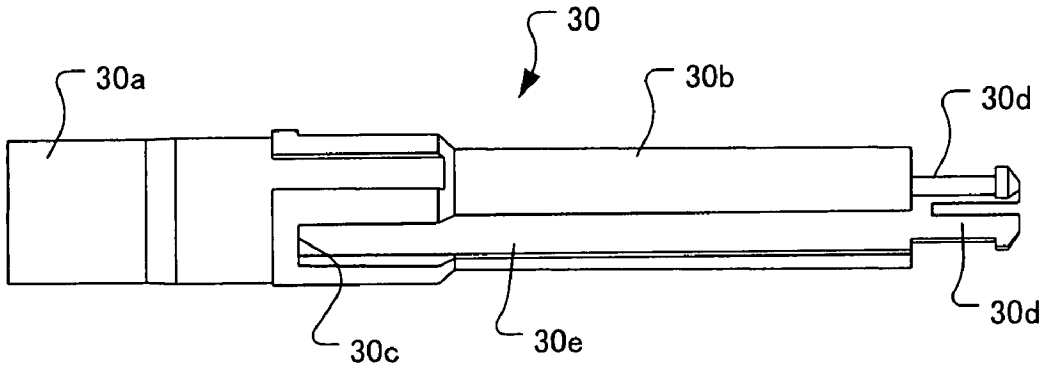

More specifically the intermediate shaft 30, as shown in detail in FIGS. 2A and 2B, has a front sleeve portion 30*a*, a guide portion 30*b*, a partitioning wall 30*c* positioned between the front sleeve portion 30*a* and the guide portion 30*b* and substantially perpendicular to the axial direction, and a plurality of (three in this case) engaging pieces 30*d* positioned at the rear end for linking the intermediate shaft 30 to the rear shaft 20 with permitting a relative rotation between them, as will be described afterwards. Each of the engaging pieces 30*d* has a stub protruding in the direction of the outside diameter at its rear end.

The outer circumferential surface of the front sleeve portion 30*a* of the intermediate shaft 30 fits onto the inner circumferential surface of the fit-in sleeve 28 to integrally fix the fit-in sleeve 28 and the intermediate shaft 30 together.

The guide portion 30*b* of the intermediate shaft 30 is smaller in diameter than the front sleeve portion 30*a*. In the guide portion 30*b*, guide grooves 30*e* extending in the axial direction are formed, the number of the guide grooves 30*e* correspond to maximum number of the writing shafts that the composite writing tool can accommodate. A plurality of through holes 30*f* communicating with the guide grooves 30*e* are formed in the partitioning wall 30*c*.

Within the front shaft 10, a plurality of (three in this case) writing shafts 40, 42 and 42 are accommodated. Out of these writing shafts 40, 42 and 42, one writing shaft 40 is a mechanical pencil shaft containing a known lead feeding mechanism for feeding a lead by a determined amount, whereas the remaining two writing shafts 42 (in FIG. 1, one of them is on the unrepresented side and accordingly invisible, and all the writing shafts in the retracted state are expressed in imaginary lines) are ballpoint pen shafts of different colors. Of course the combination of writing shafts is not limited to this one, but any desired writing shafts including an eraser shaft can be combined. The rear parts of the writing shafts 40, 42 and 42, penetrating the respectively corresponding the through holes 30*f* formed in the partitioning wall 30*c* of the intermediate shaft 30, extend into the rear shaft 20, and cam sliders 44 are fitted to their rear ends. Return springs 46, which are elastic members, are interposed between the cam sliders 44 and the partitioning wall 30*c*, to always urge the writing shafts 40, 42 and 42 backward.

Figure 3A:
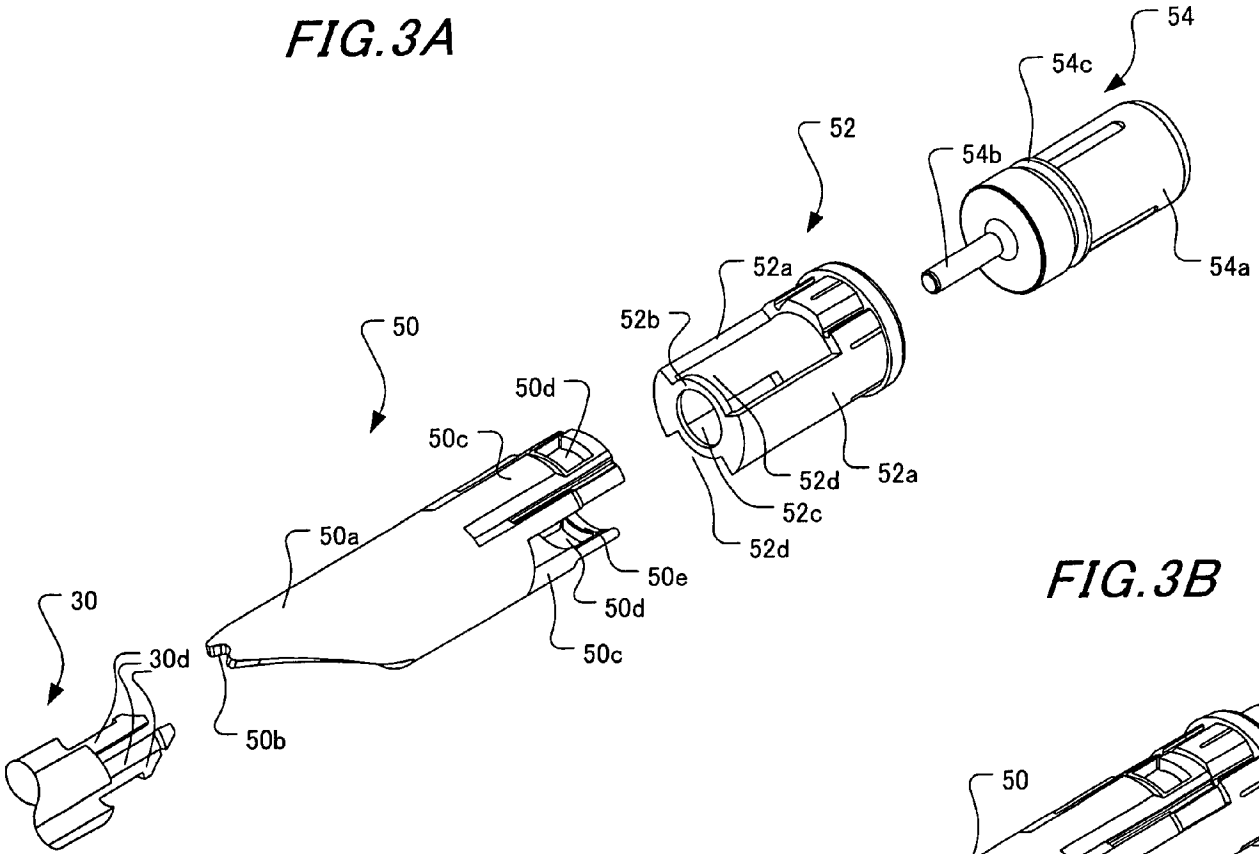
FIG. 3A is an exploded perspective view of a cam sleeve, a tail cap, a knock sleeve and a rear part of the intermediate shaft
Figure 3B:
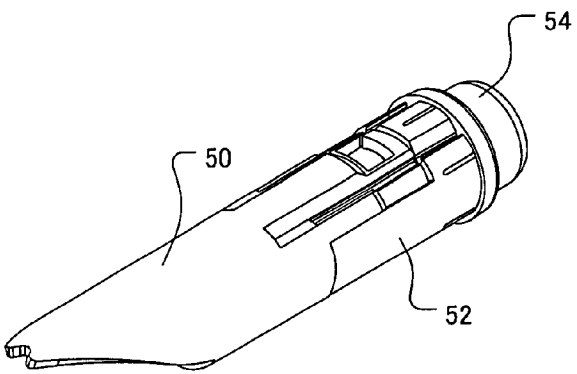
FIG. 3B is a perspective view of the cam sleeve, the tail cap and the knock sleeve in their assembled state.
Figure 4A:
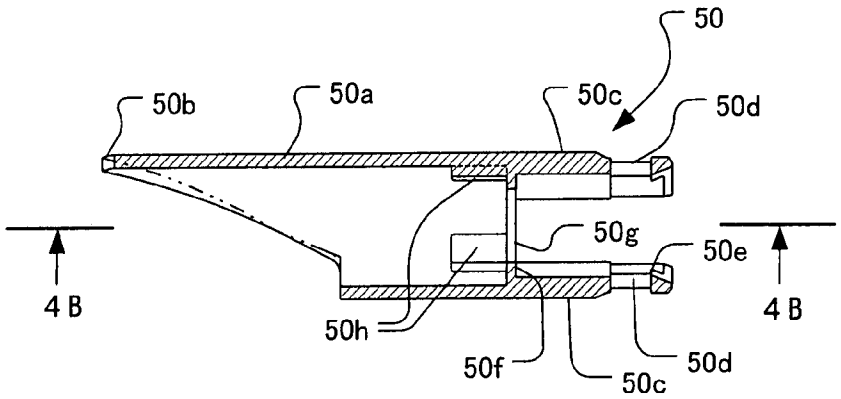
FIG. 4A shows a longitudinal section of the cam sleeve.
Figure 4B:
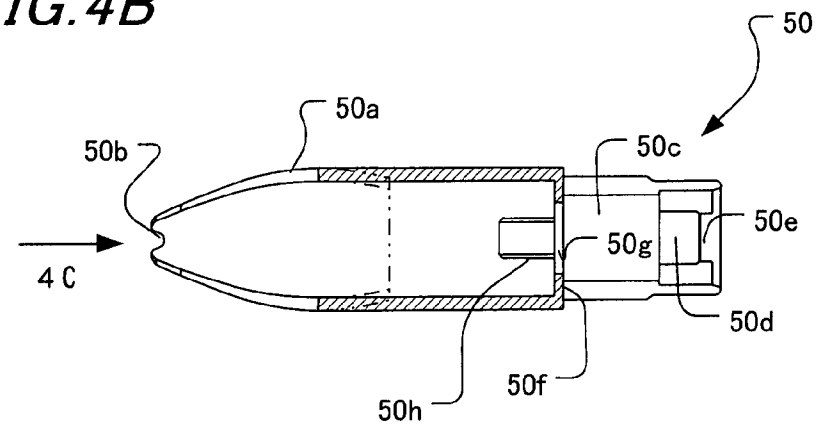
FIG. 4B, a sectional view taken at line 4B—4B in FIG. 4A.
Figure 4C:
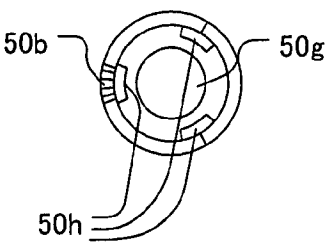
FIG. 4C, a view seen in the direction of arrow 4C in FIG. 4B.

A cam sleeve 50 is disposed in the rear inner space of the rear shaft 20. A spearhead-shaped cam projection 50*a* is formed at the tip of the cam sleeve 50 as shown in FIGS. 3 and 4, and an engaging recess 50*b* is formed at the tip of the cam projection 50*a*. The end of engaging projections 44*a* of the cam sliders 44 (see FIG. 1) can engage with the engaging recess 50*b*.

A pair of engaging pieces 50*c* and 50*c* are formed at the rear end of the cam sleeve 50, an engaging hole 50*d* is formed in each engaging piece 50*c*, and engaging projections 50*e* and 50*e* protruding in the direction of the inside diameter are formed on the rear end edge of the engaging hole 50*d*.

A partitioning wall 50*f* perpendicular to the axial direction is formed within the cam sleeve 50, and a through hole 50*g* is formed in the central part of the partitioning wall 50*f*. Further, knock restricting projections 50*h* to restrict knocking are formed on the inner circumferential surface of the cam sleeve 50 ahead of the partitioning wall 50*f*. The knock restricting projections 50*h* can enter the guide grooves 30*e* and thereby enable the cam sleeve 50 to advance into the intermediate shaft 30 only when the positional relationship of relative rotation between the intermediate shaft 30 and the cam sleeve 50 is such that the knock restricting projections 50*h* of the cam sleeve 50 align with the guide grooves 30*e* of the intermediate shaft 30.

Figure 5B:
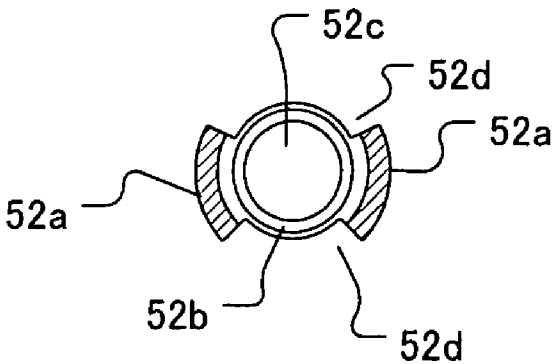
FIG. 5B, a sectional view taken at line 5B—5B in FIG. 5A.
Figure 5A:
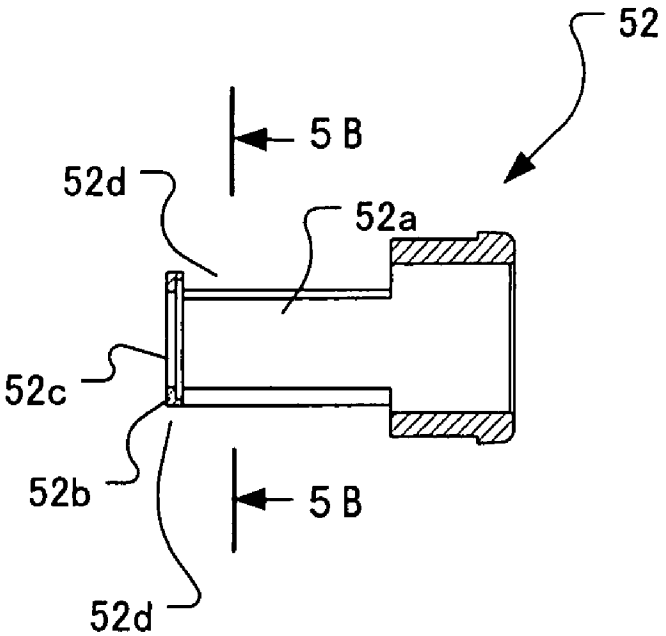
FIG. 5A shows a longitudinal section of the tail cap.
Figure 6A:
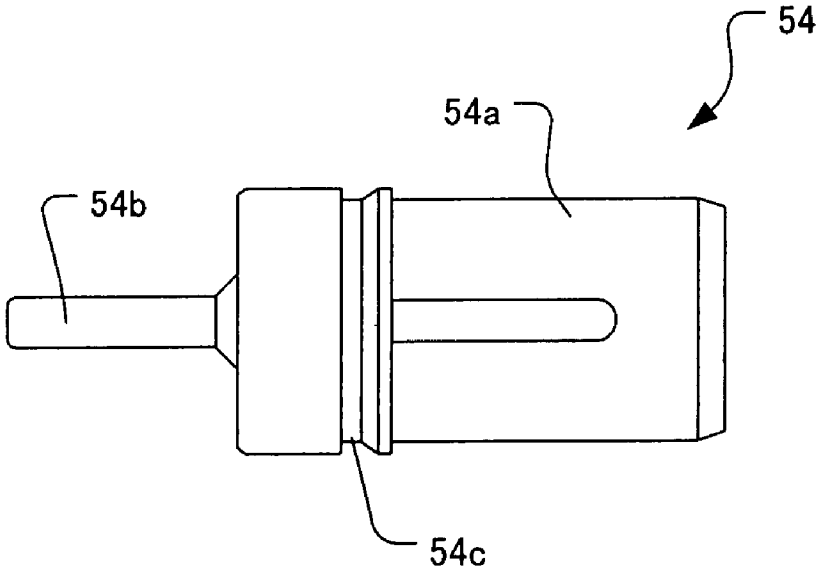
FIG. 6A is a plan of the knock sleeve and FIG. 6B, a longitudinal section of the same.
Figure 6B:
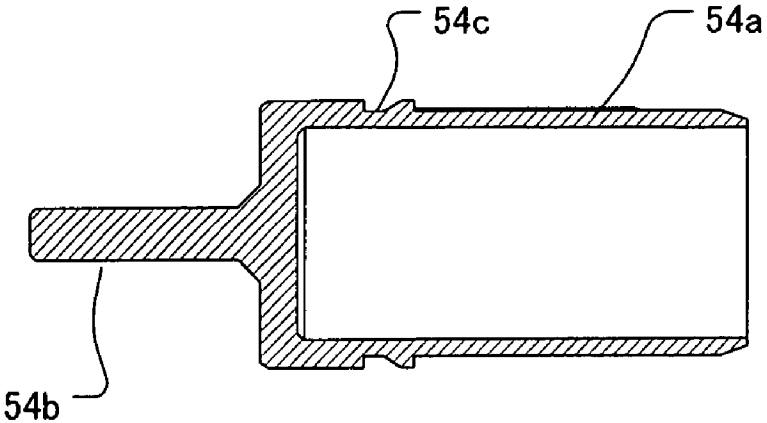

A tail cap 52 is assembled to the rear part of the cam sleeve 50. The tail cap 52 is fastened by being pressed into the rear end of the rear shaft 20 or otherwise. As shown in FIGS. 3 and 5, the tail cap 52 has a pair of legs 52*a* and 52*a* extending forward, and the front ends of the legs 52*a* and 52*a* are connected to each other by an engaging wall 52*b*. The engaging wall 52*b* is perpendicular to the axial direction, a through hole 52*c* is formed in the central part of the engaging wall 52*b*, and recesses 52*d* and 52*d*, which are openings extending in an arc shape, are formed on a radially outside portion from the through hole 52*c*.

A knock sleeve 54 is assembled to the rear part of the cam sleeve 50. The knock sleeve 54 has an eraser receptacle 54*a* opening backward and a restricting rod 54*b* extending forward from the bottom of the eraser receptacle 54*a*. An eraser 56 with a jacket 55 (see FIG. 1) is inserted into the eraser receptacle 54*a*. An annular engaging groove 54*c* with which the engaging projections 50*e* of the cam sleeve 50 are to engage is formed in the outer circumferential surface of the knock sleeve 54.

As shown in FIG. 1, an eraser cover 58 (see FIG. 1) is put on the knock sleeve 54 as appropriate. A clip can be attached to the rear shaft 20 as appropriate, and the base of that clip can be inserted into a space surrounded by the cam sleeve 50, the tail cap 52 and the rear shaft 20.

Figure 7A:
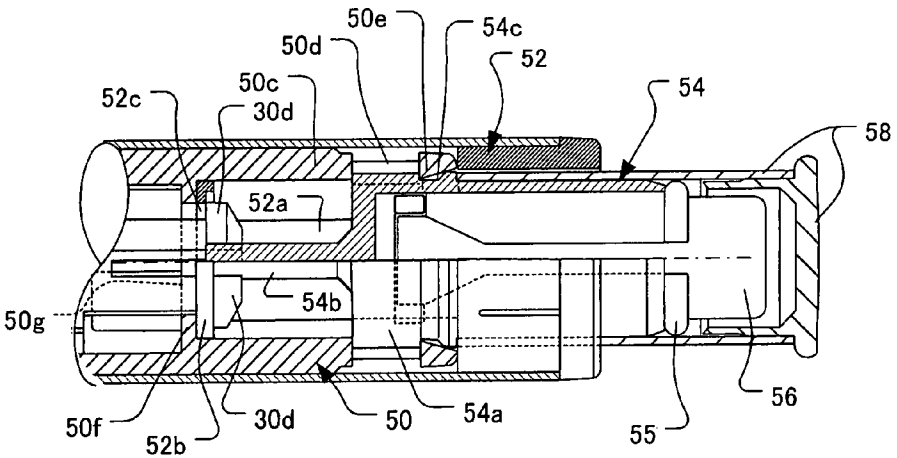
FIGS. 7A and 7B show expanded sections (including partial side views) of the essential part of FIG. 1, FIG. 7A showing a state in which the knock sleeve is not knocked and FIG. 7B, a state in which the knock sleeve is knocked.

The assembling of these cam sleeve 50, tail cap 52, knock sleeve 54 and intermediate shaft 30 within the rear shaft 20 will be described in detail below with reference to FIGS. 3 and 7.

As the force by the return springs 46 works on the intermediate shaft 30 to thrust out forward, the intermediate shaft 30 has to be restricted in forward motion in the axial direction and at the same to be arranged rotatably within the rear shaft 20. For this reason, the intermediate shaft 30 is attached to the rear shaft 20 via the tail cap 52 fastened to the rear shaft 20.

More specifically, first the engaging pieces 50*c* and 50*c* of the cam sleeve 50 are let pass the recesses 52*d* formed in the engaging wall 52*b* of the tail cap 52, inserted between the legs 52*a* and 52*a* of the tail cap 52, and the partitioning wall 50*f* of the cam sleeve 50 and the engaging wall 52*b* of the tail cap 52 are brought close to each other to align the through hole 50*g* in the partitioning wall 50*f* and the through hole 52*c* in the engaging wall 52*b*. Then the rear part of the intermediate shaft 30 is inserted into the cam sleeve 50 from the front and, after letting the engaging pieces 30*d* of the intermediate shaft 30 pass the through hole 50*g* in the partitioning wall 50*f* and the through hole 52*c* in the engaging wall 52*b* of the tail cap 52, the rear ends of the engaging pieces 30*d* are engaged with the engaging wall 52*b*. Next, the knock sleeve 54 is inserted into the tail cap 52 from behind, the front of its eraser receptacle 54*a* is brought into contact with the front edge of the engaging hole 50*d* in the cam sleeve 50, and the engaging projections 50*e* and 50*e* of the cam sleeve 50 are fitted into the engaging groove 54*c*. Since both the engaging hole 50*d* and the engaging projections 50*e* of the cam sleeve 50 are formed on the engaging pieces 50*c* and the engaging pieces 50*c* can elastically expand when the knock sleeve 54 is inserted, the assembly is easy, with no fear of damaging the knock sleeve 54 during the assembling process. The restricting rod 54*b* of the knock sleeve 54 is inserted within and between the plurality of the engaging pieces 30*d* of the intermediate shaft 30 to prevent the engaging pieces 30*d* from falling in the direction of the inside diameter and thereby disengaging the engaging wall 52*b*.

Figure 7B:
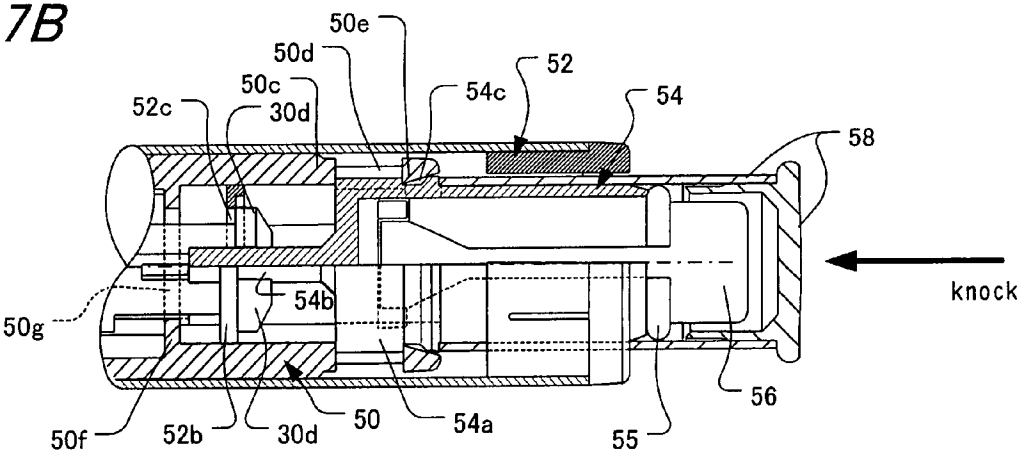

The assembly constituted by the cam sleeve 50, the tail cap 52, the knock sleeve 54 and the intermediate shaft 30, assembled as described above, is inserted from behind the rear shaft 20, and the tail cap 52 is pressed into the rear shaft 20 to be fixed within the rear shaft 20. The cam sleeve 50 and the knock sleeve 54 are linked to be operatively movable forward together. Since the engaging pieces 50*c* of the cam sleeve 50 engage the engaging wall 52*b* of the tail cap 52 and the legs 52*a*, the cam sleeve 50 is unable to rotate relative to the rear shaft 20. On the other hand, when the knock sleeve 54 is knocked forward, the cam sleeve 50 can move forward together with the knock sleeve 54 (FIG. 7B).

Now will be described the operation of the composite writing tool configured as described above. FIG. 1 shows a state in which the writing shaft 40, which is a mechanical pencil shaft, protrudes, and in this state the rear end of the engaging projection 44*a* of the cam slider 44 fitted to the rear end of the writing shaft 40 is engaged with the engaging recess 50*b* of the cam sleeve 50, and the tip of the writing shaft 40, with its tip protruding out of the tip opening 10*a* of the front shaft 10, can be used for writing.

When the rear shaft 20 is rotated relative to the front shaft 10 in this state, the cam sleeve 50 rotates together with the rear shaft 20 relative to the front shaft 10 and the intermediate shaft 30, and the engaging projections 44*a* of the cam slider 44 and the engaging recess 50*b* of the cam sleeve 50 are disengaged from each other, and the writing shaft 40, protruding until then, is retracted by the urging force of the return spring 46 while sliding on the oblique surface of the cam projection 50*a* of the cam sleeve 50. In this way, a state in which all the writing shafts 40, 42 and 42 are retracted (expressed in imaginary lines in FIG. 1) can be achieved. Further, when the rear shaft 20 is rotated relative to the front shaft 10, the cam slider 44 of another writing shaft 42 engages with the engaging recess 50*b* of the cam sleeve 50, and that writing shaft 42 protrudes. In this way, the successive rotation of the rear shaft 20 and the front shaft 10 relative to each other selectively protrudes one writing shaft or another to make it usable for writing.

When it becomes necessary to feed out the lead in the state shown in FIG. 1 in which the mechanical pencil writing shaft 40 is protruding, the user knocks the knock sleeve 54. Knocking the knock sleeve 54 causes the cam sleeve 50 linked to the knock sleeve 54 to be knocked, and the writing shaft 40 is knocked via the cam slider 44 engaged with the engaging recess 50*b* of the cam sleeve 50. As an outer sleeve portion of the front of the writing shaft 40 comes into contact with the inner circumferential surface of the front shaft 10, the chuck C within the writing shaft 40 is forced out, and a lead L is fed out by the action of a known lead feeding mechanism.

When the writing shaft 40 is to be refilled with a new lead, it can be accomplished by removing the front shaft 10 from the fit-in sleeve 28, and separating the front shaft 10 from the intermediate shaft 30 and the rear shaft 20 to expose the writing shaft 40.

As described so far, when one or another of the writing shafts 40, 42 and 42 is to be selectively protruded according to the invention, as the rear shaft 20 is rotated relative to the front shaft 10, the rotation can be easily accomplished and, when the writing shaft 40 is to be knocked, it is accomplished by knocking the knock sleeve 54, but the whole rear shaft 20 is not knocked, resulting in improved operativity. Since the knock sleeve 54 and the cam sleeve 50 are linked to each other via the recesses 52*d* and 52*d* as openings, the knocking force of the knock sleeve 54 is securely transmitted to the cam sleeve 50.

The smaller-diameter guide portion 30*b* in the rear part of the intermediate shaft 30, is disposed within the rear shaft 20 without becoming bulky and its engaging pieces 30*d* are engaged with the engaging wall 52*b* which is fixed in the axial direction within the rear shaft 20 without becoming bulky, as a result, the outside diameter of the shaft can be reduced.

Second Preferred Embodiment

Figure 8:
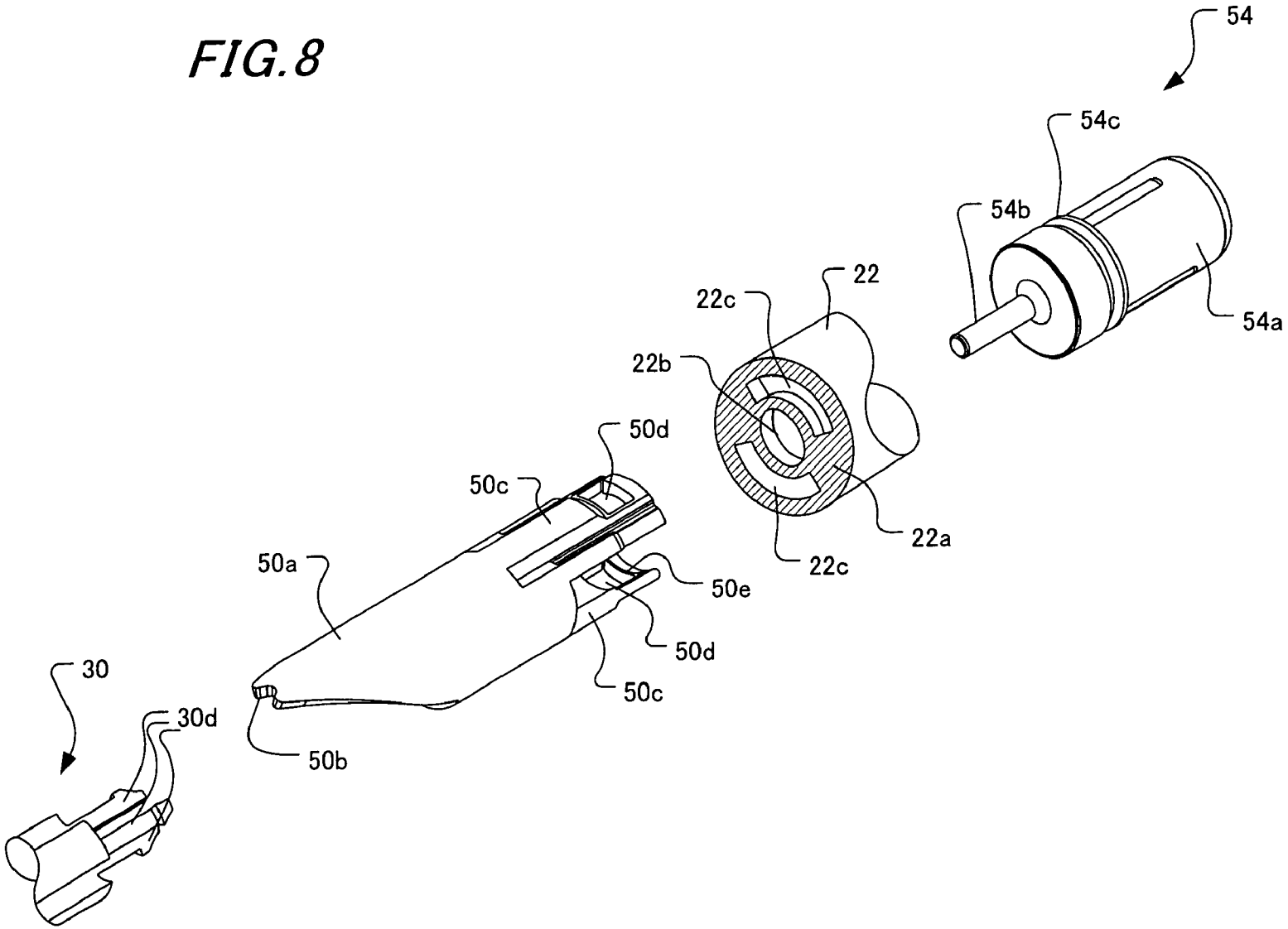
FIG. 8 shows a partial perspective view of an essential part of a second preferred embodiment according to the present invention.

FIG. 8 shows a partial perspective view of the essential part of a second preferred embodiment of the present invention. Since other elements than those shown here can be configured in the same way as their respective counterparts in the first embodiment, their illustration and description are omitted.

In this embodiment, as the rear shaft 22 is made of plastic and the tail cap 52 for fixing the intermediate shaft 30 is omitted. FIG. 8 shows a part of the rear shaft 22 cut along a prescribed section. An engaging wall 22*a* vertical to the axial direction is formed within the rear shaft 22, and a through hole 22*b* is formed in the central part of the engaging wall 22*a*. Openings 22*c* and 22*c* extending in an arc shape are formed around the through hole 22*b*.

The engaging pieces 30*d* of the intermediate shaft 30, after penetrating the through hole 50*g* in the partitioning wall 50*f* of the cam sleeve 50, also penetrate the through hole 22*b* of the rear shaft 22, and their rear ends are engaged with the engaging wall 22*a*. The engaging pieces 50*c* and 50*c* of the cam sleeve 50 penetrate the openings 22*c* and 22*c* in the rear shaft 22, and the knock sleeve 54 and the cam sleeve 50 are linked to each other as the knock sleeve 54 engages with the engaging pieces 50*c* and 50*c* in the same manner as in the first embodiment. In this way, when the user knocks the knock sleeve 54, the cam sleeve 50 is knocked.

In this way, the second embodiment can provide the same operations as the first embodiment does, and it is made possible to dispense with the tail cap 52.

Third Preferred Embodiment

Figure 9:
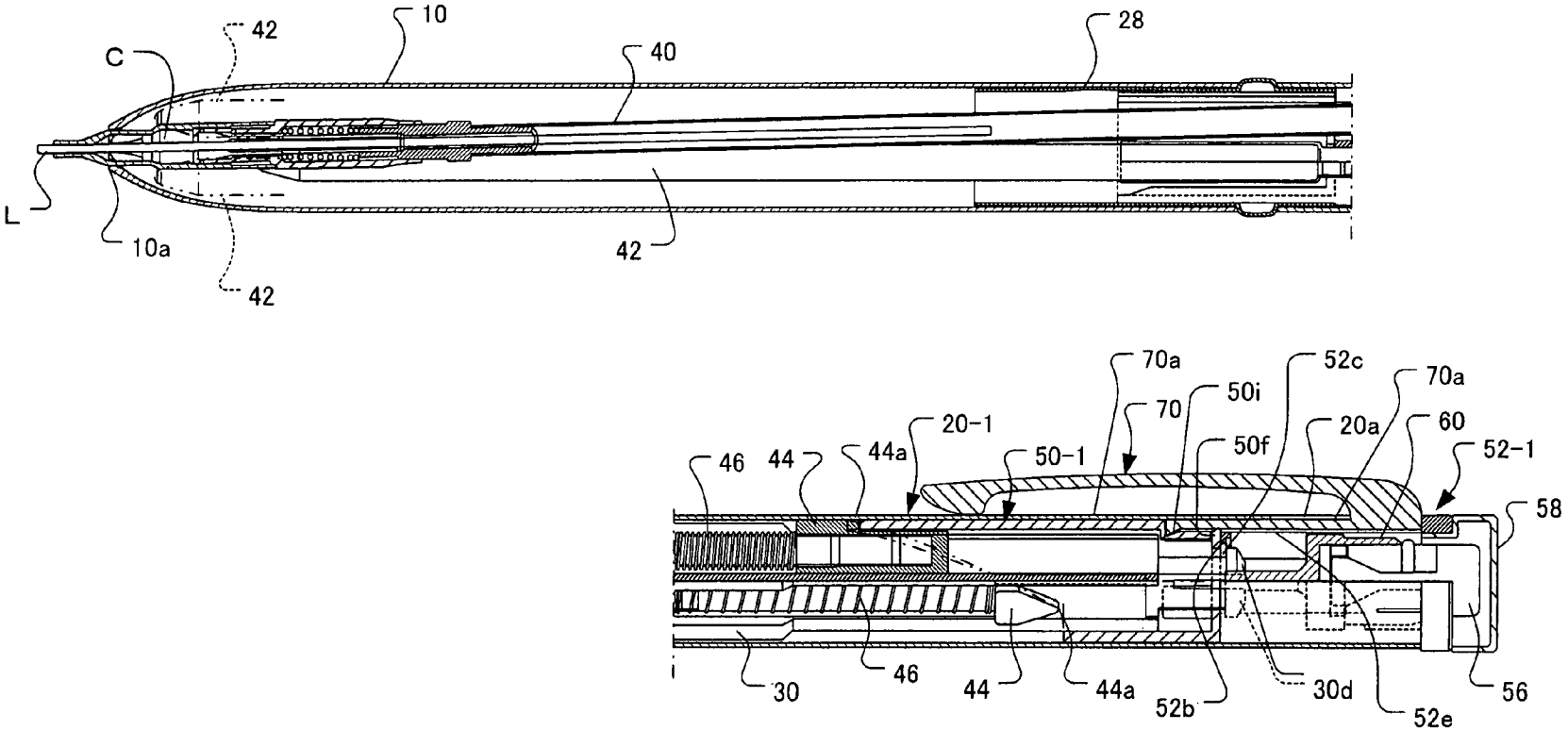
FIG. 9 shows an overall longitudinal section (including a partial side view) of a composite writing tool of a third preferred embodiment according to the present invention.
Figure 10:
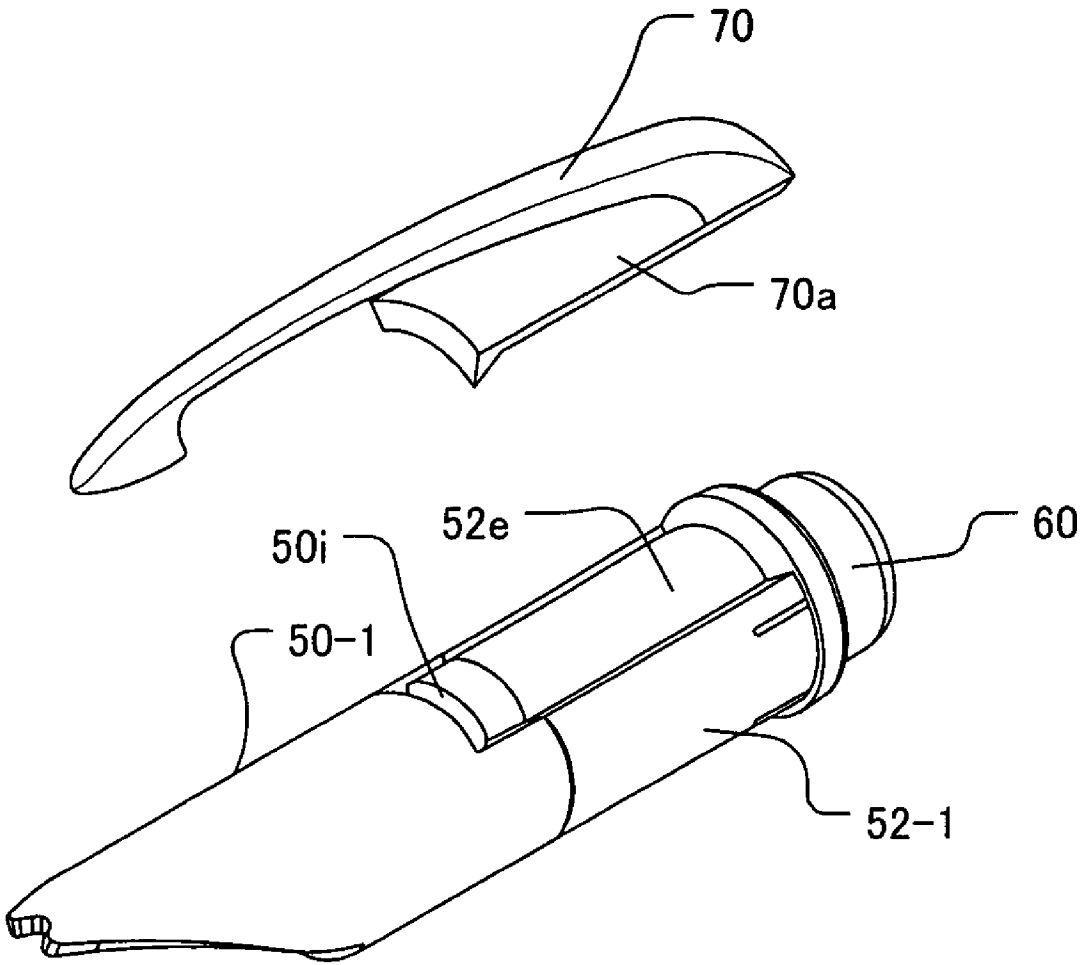
FIG. 10 shows a perspective view of the cam sleeve, the tail cap and the eraser receptacle pertaining to the third preferred embodiment according to the present invention in their assembled state.

FIGS. 9 and 10 show a composite writing tool according to a third preferred embodiment of the present invention. In the drawings, the same elements as in the first embodiment are denoted by respectively the same reference numerals, and their description is omitted.

In this embodiment, the knocking member is replaced with a clip 70, and an eraser receptacle 60 fixed to a tail cap 52-1 is provided in place of the knock sleeve 54 in the first embodiment.

An opening 20*a* is formed in a side surface of the rear shaft 20-1. As a base 70*a* of the clip 70 passes the opening 20*a* and the base 70*a* extends into the rear shaft 20-1 and further into a slot 52*e* formed in the tail cap 52-1 to engage with an engaging concave 50*i* of the cam sleeve 50-1, the clip 70 and the cam sleeve 50-1 are linked to each other. Thus, the cam sleeve 50-1 and the clip 70 are linked to each other through the opening 20*a*.

The opening 20*a* of the rear shaft 20-1 extends in the axial direction, leaving an allowance for the knocking by the clip 70 in the axial direction.

As in the first embodiment, the engaging pieces 30*d* at the rear end of the intermediate shaft 30 penetrate the through hole 52*c* in the tail cap 52-1 and are engaged with the engaging wall 52*b*.

In the composite writing tool configured in this way, when the clip 70 is knocked to feed a lead of the writing shaft 40, the rear shaft 20-1 is not wholly knocked, resulting in improved operativity. Since the clip 70 and the cam sleeve 50-1 are linked to each other via the opening 20*a*, the knocking force of the clip 70 is securely transmitted to the cam sleeve 50-1 to provide similar effects and benefits to the foregoing embodiments.

Fourth Preferred Embodiment

Figure 11:
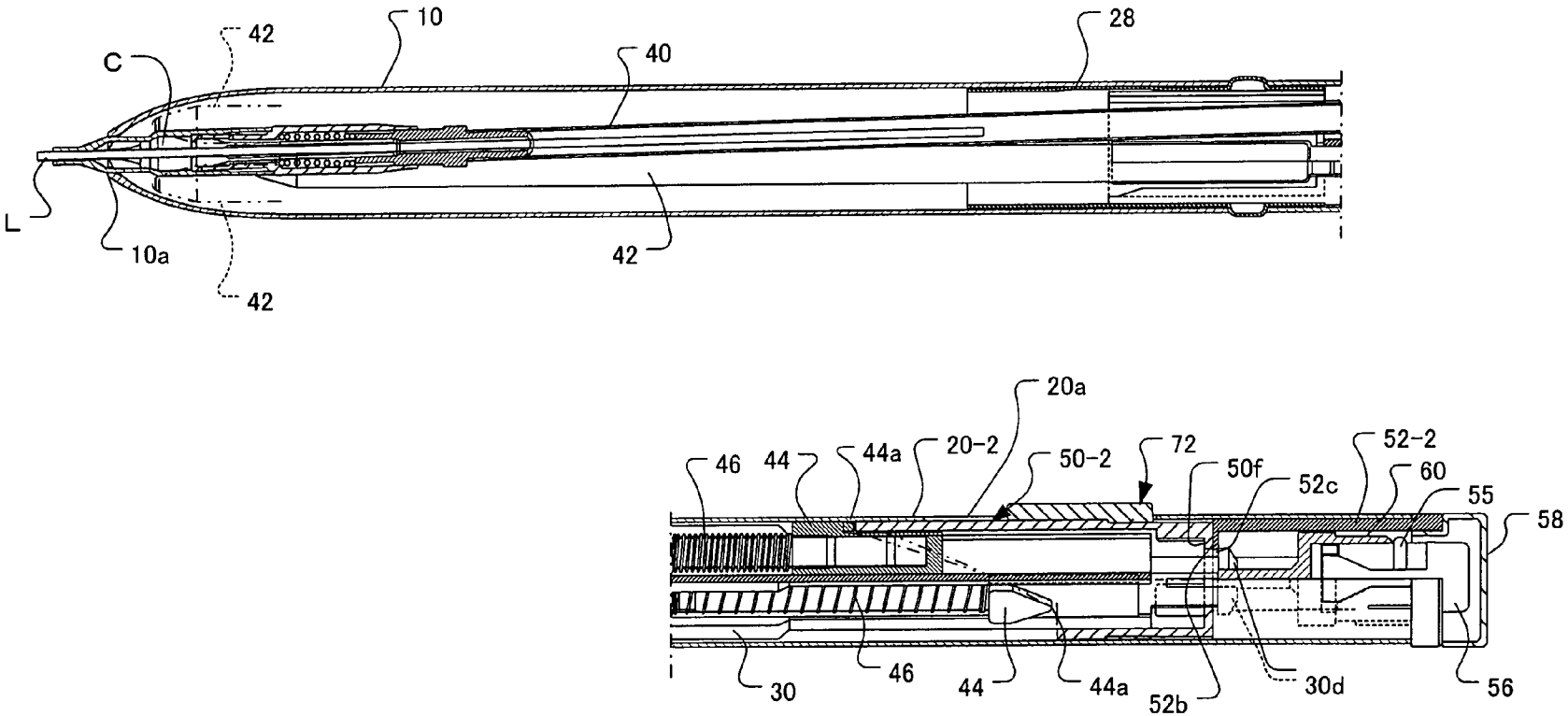
FIG. 11 shows an overall longitudinal section (including a partial side view) of a composite writing tool of a fourth preferred embodiment according to the present invention.

FIG. 11 shows a composite writing tool according to a fourth preferred embodiment of the present invention. In the drawing, the same elements as in the first and third embodiments are denoted by respectively the same reference numerals, and their description is omitted.

In this embodiment, the knocking member is a side knock member 72, and the eraser receptacle 60 fixed to a tail cap 52-2 is provided in place of the knock sleeve 54 in the first embodiment.

The opening 20*a* is formed in a side surface of the rear shaft 20-2. As the annular base 72*a* of the side knock member 72 passes the opening 20*a* and the base 70*a* extends into the rear shaft 20-2 and is engaged with the outer circumferential surface of the cam sleeve 50-2, the side knock member 72 and the cam sleeve 50-2 are linked to each other. Thus, the cam sleeve 50-2 and the side knock member 72 are linked to each other through the opening 20*a*.

The opening 20*a* of the rear shaft 20-2 extends in the axial direction, leaving an allowance for the knocking by the side knock member 72 in the axial direction.

As in the first embodiment, the engaging pieces 30*d* at the rear end of the intermediate shaft 30 penetrate the through hole 52*c* in the tail cap 52-2 and are engaged with the engaging wall 52*b*.

In the composite writing tool configured in this way, when the side knock member 72 is knocked to feed a lead of the writing shaft 40, the rear shaft 20-2 is not wholly knocked, resulting in improved operativity. Since the side knock member 72 and the cam sleeve 50-2 are linked to each other via the opening 20*a*, the knocking force of the side knock member 72 is securely transmitted to the cam sleeve 50-2 to provide similar effects and benefits to the foregoing embodiments.

What is claimed is:

1. A composite writing tool comprising:

a front shaft for accommodating a plurality of writing shafts always urged backward;

a rear shaft;

an intermediate shaft between the front shaft and the rear shaft for guiding the writing shafts in the axial direction, said intermediate shaft being unrotatably coupled to the front shaft and rotatably coupled to the rear shaft;

a cam sleeve disposed within the rear shaft so as to be unrotatable and movable in the axial direction relative to the rear shaft, for selectively protruding one of the writing shafts and retracting all of the writing shafts upon a relative rotation between the cam sleeve and, the front shaft and the intermediate shaft; and a knocking member coupled to the cam sleeve and protruding out of the rear shaft, whereby knocking of the knocking member allows the writing shaft protruded by the cam sleeve to be subjected to a knocking operation, wherein a rear part of the intermediate shaft is inserted into the cam sleeve and a rear end of the intermediate shaft penetrates a through hole formed in an engaging wall perpendicular to the axial direction within the rear shaft and is engaged with the through hole, and wherein the cam sleeve and the knocking member are coupled to each other through an opening provided one of within the rear shaft and in the rear shaft.

2. The composite writing tool according to claim 1, wherein said opening is formed elsewhere than a portion formed with said through hole in said engaging wall.

3. The composite writing tool according to claim 1, wherein said opening includes a non-annular opening formed in the engaging wall or between the engaging wall and the rear shaft and positioned at an outer portion in a radial direction than the through hole.

4. The composite writing tool according to claim 1, wherein an engaging piece passing said opening is formed at the rear end of said cam sleeve, and the knocking member is linked to the engaging piece.

5. The composite writing tool according to claim 1, wherein said knocking member includes a clip.

6. The composite writing tool according to claim 1, wherein said opening is formed in a side surface of said rear shaft.

7. The composite writing tool according to claim 1, wherein said engaging wall is formed in a tail cap fastened to a rear end of said rear shaft.

8. The composite writing tool according to claim 1, wherein said engaging wall is formed integrally with said rear shaft.

9. The composite writing tool according to claim 2, wherein said opening includes a non-annular opening formed in the engaging wall or between the engaging wall and the rear shaft and positioned at an outer portion in a radial direction than the through hole.

10. The composite writing tool according to claim 2, wherein an engaging piece passing said opening is formed at the rear end of said cam sleeve, and the knocking member is linked to the engaging piece.

11. The composite writing tool according to claim 3, wherein an engaging piece passing said opening is formed at the rear end of said cam sleeve, and the knocking member is linked to the engaging piece.

12. The composite writing tool according to claim 5, wherein said opening is formed in a side surface of said rear shaft.

* * * * *